US009488357B1

(12) United States Patent
Engberg

(10) Patent No.: US 9,488,357 B1
(45) Date of Patent: Nov. 8, 2016

(54) LIGHTING APPARATUS WITH IMPROVED THERMAL INSULATION

(71) Applicant: CHM Industries, Inc., Saginaw, TX (US)

(72) Inventor: Scott Engberg, Dallas, TX (US)

(73) Assignee: CHM Industries, Inc., Saginaw, TX (US)

( * ) Notice: Subject to any disclaimer, the term of this patent is extended or adjusted under 35 U.S.C. 154(b) by 288 days.

(21) Appl. No.: 13/866,897

(22) Filed: Apr. 19, 2013

(51) Int. Cl.

| | |
|---|---|
| ***F21V 29/02*** | (2006.01) |
| ***H01J 61/52*** | (2006.01) |
| ***F21V 29/83*** | (2015.01) |
| ***F21V 29/00*** | (2015.01) |
| ***F21V 29/502*** | (2015.01) |

(52) U.S. Cl.
CPC ..... *F21V 29/02* (2013.01); *F21V 29/004* (2013.01); *F21V 29/502* (2015.01); *F21V 29/83* (2015.01); *H01J 61/52* (2013.01)

(58) Field of Classification Search
CPC .... F21V 23/026; F21V 29/83; F21V 29/004; F21V 29/505; F21V 29/502; F21V 29/02; H01J 61/52
USPC ..... 362/218, 294, 373
See application file for complete search history.

(56) References Cited

U.S. PATENT DOCUMENTS

| | | | | |
|---|---|---|---|---|
| 2,691,092 | A * | 10/1954 | McConnell et al. | 362/223 |
| 3,895,227 | A * | 7/1975 | Murray | F21V 23/026 362/264 |
| 5,183,328 | A * | 2/1993 | Osteen | F21V 9/04 362/294 |
| 5,446,636 | A * | 8/1995 | Huang | F21V 7/0066 362/294 |
| 5,677,602 | A * | 10/1997 | Paul et al. | 315/224 |
| 6,123,435 | A * | 9/2000 | Wang | 362/263 |
| 6,183,114 | B1 * | 2/2001 | Cook et al. | 362/294 |
| 6,641,422 | B2 * | 11/2003 | Duggan | H01J 5/58 313/49 |
| 7,476,010 | B2 * | 1/2009 | Johnson | 362/373 |
| 2006/0232984 | A1 * | 10/2006 | Schuknecht et al. | 362/373 |
| 2007/0262719 | A1 * | 11/2007 | Lau | 313/634 |
| 2013/0314929 | A1 * | 11/2013 | Manahan | 362/373 |

* cited by examiner

*Primary Examiner* — Robert May
(74) *Attorney, Agent, or Firm* — Gardere Wynne Sewell LLP

(57) ABSTRACT

A lighting apparatus is described that may include a ballast housing, a lighting element housing and a ventilation chamber. The lighting element housing may include a lighting element. The ventilation chamber may be disposed between the ballast housing and the light element housing to maintain a predetermined distance between the ballast housing and the lighting element housing to reduce heat transferred from the lighting element to the ballast housing.

18 Claims, 4 Drawing Sheets

LIGHTING APPARATUS WITH IMPROVED THERMAL INSULATION

TECHNICAL FIELD

This disclosure relates to lighting apparatuses, and more particularly to high-efficiency lighting apparatuses with improved thermal insulation, and even more particularly to high-efficiency lighting apparatuses with improved thermal insulation for high mast applications.

BACKGROUND OF THE DISCLOSURE

Lighting mechanisms include one or more lighting elements, and associated components, that produce large amounts of heat during operation. Many lighting mechanisms, however, also require controls for the lighting elements, such as a capacitor, igniter and/or ballast, which are temperature sensitive and must remain at or below a specified working temperature to prevent damage to the controls, to maximize the overall efficiency of the lighting mechanism and to maximize the useful life of the lighting mechanism. As such, it has long been a challenge to create lighting mechanisms that incorporate the high-temperature lighting elements and associated operational components with the temperature-sensitive controls in a single unit.

For example, current single-unit lighting mechanisms oftentimes mount heat-sensitive controls directly adjacent to the high-temperature lighting element and/or fail to provide for adequate thermal insulation between the controls and the lighting element. As such, the controls are often exposed to excessive temperatures; thus, the overall efficiency, reliability and useful life of the lighting mechanism is substantially reduced. It would be beneficial to have a compact lighting mechanism useful for all conditions of service that includes both the controls and the lighting element(s) in a single unit while still providing adequate thermal insulation between temperature-sensitive elements and heat generating elements.

SUMMARY

In a first aspect, there is provided a high mast lighting apparatus that includes a ballast housing; a lighting element housing including a lighting element; and a ventilation chamber disposed between the ballast housing and the light element housing and maintaining a predetermined distance between the ballast housing and the lighting element housing.

In certain embodiments, the high mast lighting apparatus includes one or more spacers coupling the ballast housing and the lighting element housing. The one or more spacers may maintain a distance between the ballast housing and the lighting element housing of between about two inches and about five inches.

In other embodiments, the ventilation chamber includes a perforated metal screen disposed between the ballast housing and the lighting element housing.

In yet another embodiment, the lighting element housing includes a filter to filter air that enters and exits the lighting element housing.

In still another embodiment, the lighting element housing includes a shroud, a cover and a vent, and air flow into and out of a volume between the shroud and the cover is restricted to the vent.

In other embodiments, the ventilation chamber includes a heat dissipation pathway for providing a heat passageway from the lighting element away from the ballast housing.

In some embodiments, the heat dissipation pathway includes a conduit with one or more baffles.

In other embodiments, the ballast housing includes a main housing, a cover connectable to the main housing, and a ballast. The ballast may be connected to the cover and the cover may include at least one cooling fin disposed on an opposite side of the cover from the ballast to dissipate heat generated from the ballast.

In certain embodiments, the ballast housing includes a ballast and a heat shield, and the ballast is located inside the heat shield.

In a second aspect, there is provided a lighting apparatus that includes a ballast electrically connected to a lighting element; and a ventilation chamber located between the ballast and the lighting element. The ventilation chamber may include a heat dissipation pathway for diverting heat from the lighting element away from the ballast.

In certain embodiments, the lighting element is a high intensity discharge light.

In other embodiments, the ballast is a pulse start ballast.

In yet another embodiment, the ballast is an electronic ballast.

In still another embodiment, the ballast is a pulse start magnetic ballast.

In some embodiments, the heat dissipation pathway includes a metal conduit with at least one baffle located within the conduit.

In certain embodiments, the lighting element is located in a lighting element housing and the lighting element housing includes a vent that directs heated air from the lighting element housing to the heat dissipation pathway.

In other embodiments, the ballast is a magnetic ballast and the apparatus includes an igniter and capacitor coupled to the magnetic ballast.

In yet other embodiments, the apparatus includes a heat shield between the magnetic ballast and the igniter and capacitor.

In a third aspect, there is provided a lighting apparatus that includes a lighting element housing; a ballast housing including a ballast; and a rigid spacer connecting the ballast housing to a lighting element housing and maintaining a distance between the ballast housing and the lighting element housing.

In certain embodiments, the lighting element housing is substantially sealed except for a vent that includes a filter.

In other embodiments, the lighting element housing includes a cord grip that provides an air tight seal around a portion of a cord connecting the lighting element housing to the ballast.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
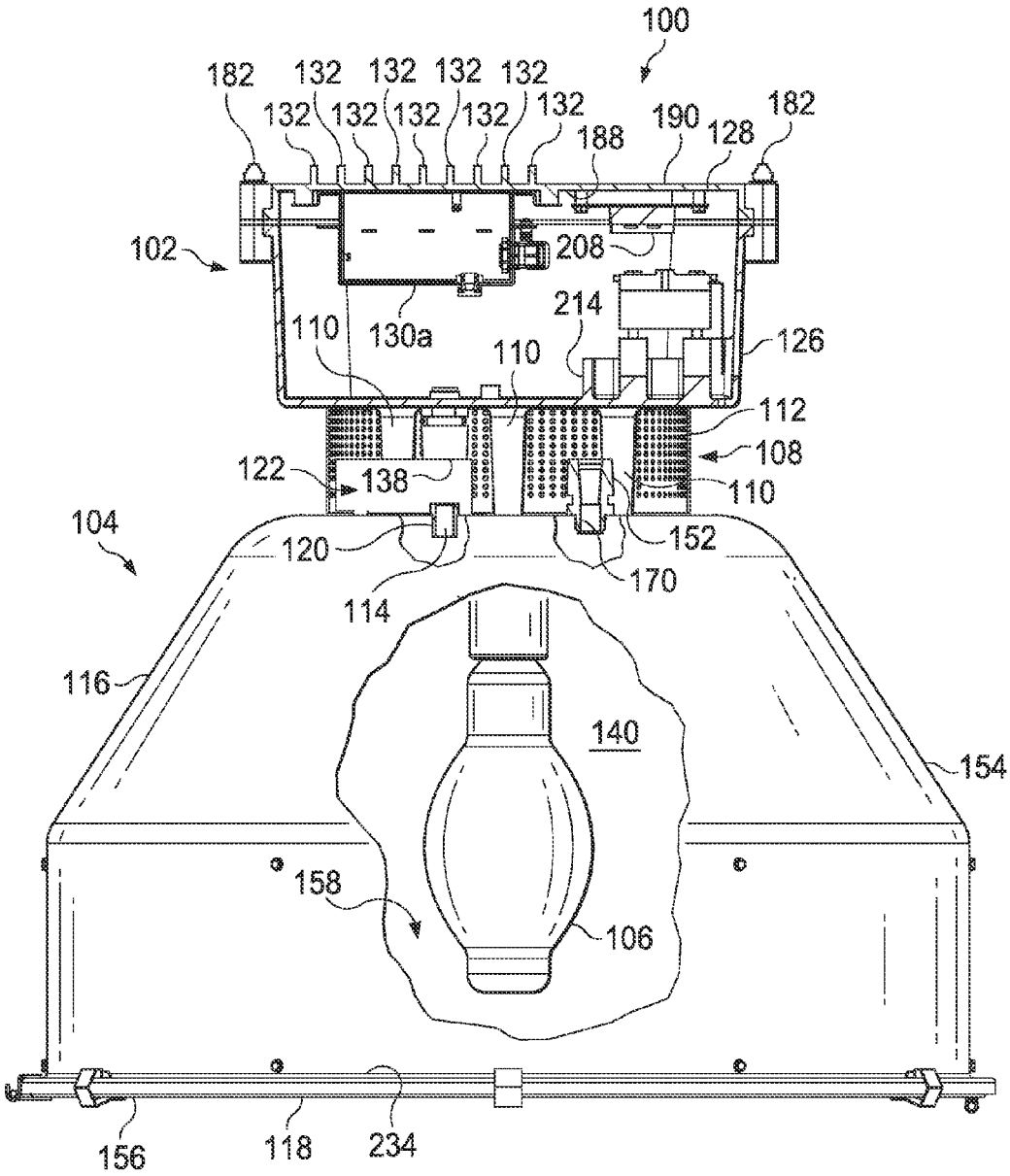
FIG. 1 is a cutaway front view of a lighting apparatus.
Figure 2:
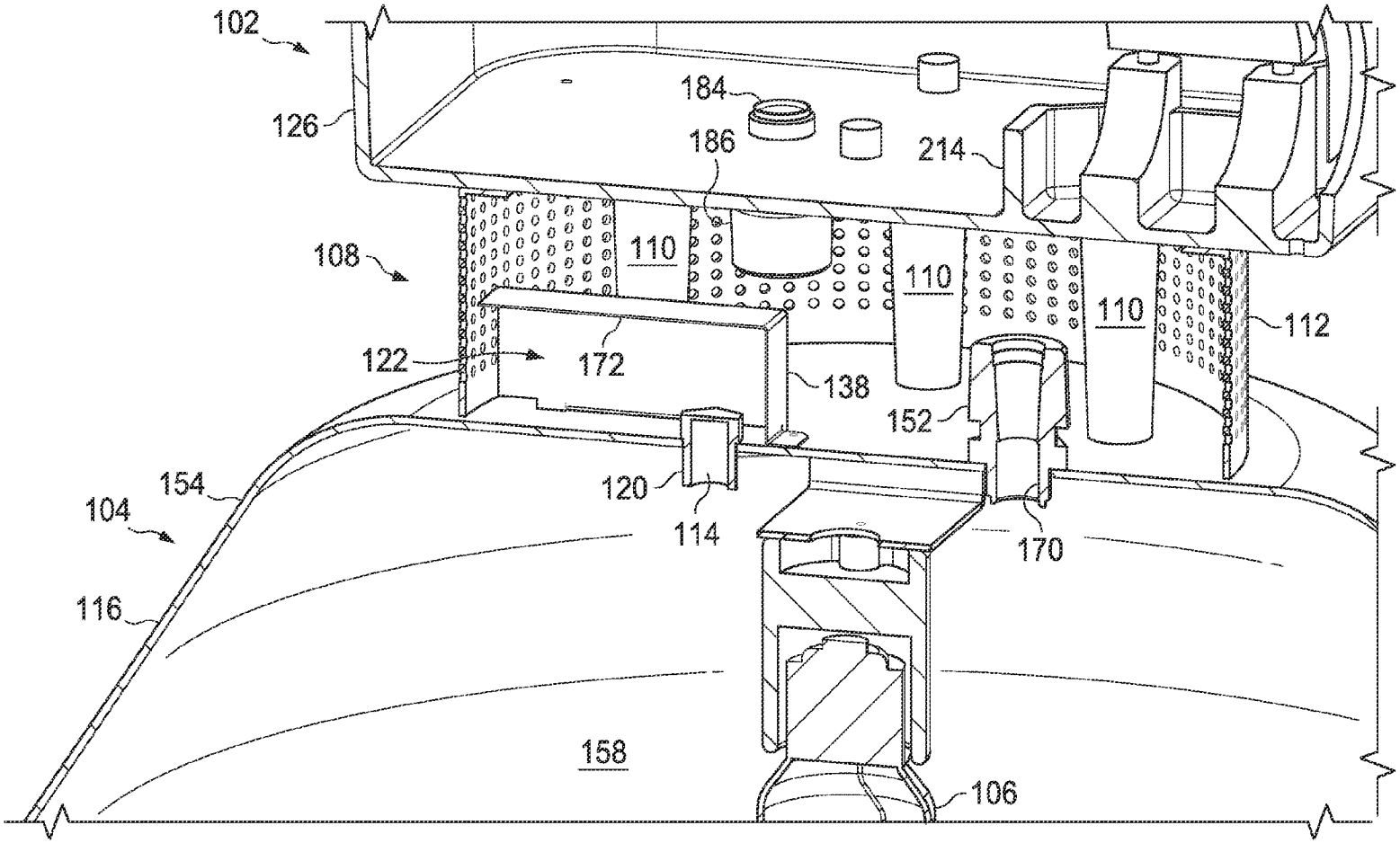
FIG. 2 is a close-up, perspective view of the lighting apparatus of FIG. 1.

Referring to FIGS. 1 and 2, a lighting apparatus 100 is shown that includes a lighting element 106 and associated controls for operating the lighting element 106, such as, for example, a ballast 130*a*. The apparatus 100 thermally isolates temperature-sensitive components, such as the ballast 130*a*, from heat-producing elements, such as the lighting element 106, in order to protect the temperature-sensitive components and to increase the overall efficiency and useful life of the lighting apparatus 100.

Referring specifically to FIG. 1, the apparatus 100 includes a lighting element housing 104, a ballast housing 102 and a ventilation chamber 108. The lighting element housing 104 is connected to and spaced from a ballast housing 102 by the ventilation chamber 108 and one or more spacers 110 located within the ventilation chamber 108. As discussed in more detail below, the ventilation chamber 108 acts to reduce and/or substantially eliminate overheating of the ballast housing 102 from heat generated from within the lighting element housing 104 by allowing at least a portion of the heat generated from the lighting element 106 to dissipate before reaching the ballast housing 102. In addition, the ballast housing 102 is configured to separate and/or otherwise enclose heat-sensitive components from heat-producing components, as discussed in more detail below.

The lighting element housing 104 includes a shroud 116, a reflective surface 140, and a lighting element 106. The shroud 116 has a generally dome-shape and may be made of any suitable material, such as, for example, metal or plastic. A reflective surface 140 is disposed on an inner surface 158 of the shroud 116 to reflect light from the lighting element 106 outward from the shroud 116. According to some embodiments, the shroud 116 includes a transparent cover 118 disposed on a bottom surface 156 of the shroud 116. The cover 118 forms an airtight seal to the shroud 116 such that the volume within the shroud 116 is completely closed off and sealed from the ambient air except for a vent 120, as discussed in greater detail below. Thus, the volume between the shroud 116 and the cover 118 is closed off from airborne contaminants in the ambient air which could contaminate a surface of the lighting element 106, an internal surface 234 of the cover 118 and/or the reflective surface 140 of the shroud 116, thereby increasing the luminaire dirt deprecation and decreasing the overall efficiency of the lighting apparatus 100. The cover 118 also prevents intrusion from living organisms, such as insects and small animals, which may damage the lighting apparatus 100 or otherwise decrease the efficiency of the lighting apparatus 100. The cover 118 may be made of any suitable material, such as, for example, glass or plastic, and may be attached to the shroud 116 by any suitable attachment mechanism(s).

In some embodiments, the apparatus 100 does not include a cover 118 and the lighting element 106 is open to the ambient air. Furthermore, in other embodiments, the cover 118 is not air-tight and may be, for example, a metal mesh that prevents entry of contaminants over a certain size into the volume between the shroud 116 and the cover 118.

The lighting element 106 located within the lighting element housing 104 may be any suitable light-producing mechanism. In some embodiments, for example, the lighting element 106 is a high intensity discharge light ("HID" light). The lighting element 106 may be any suitable wattage and may include any suitable color rendering index ("CRI"). For example, in some embodiments, the lighting element 106 is 400 watts and 68 CRI. In other embodiments, the lighting element 106 may have the following combinations of wattage and CRI: 400 W and 90 CRI; 575 W and 68 CRI; 575 W and 90 CRI; 875 W and 68 CRI; 875 and 90 CRI; and 1 kW and 68 CRI.

Referring specifically to FIGS. 1 and 2, the lighting element 106 is coupled to an electrical cord (not shown) that connects the lighting element 106 to the ballast 130*a*. In order to allow the cord to pass from the lighting element housing 104 to the ballast housing 102, the shroud 116 includes a cord opening 170 that includes a cord grip 152. The cord grip 152 creates an airtight seal around the cord to allow the cord to pass out of the lighting element housing 104 without allowing air and other particles to pass into or out of the lighting element housing 104 through the cord opening 170. The cord grip 152 may be any suitable grip, such as, for example, a stainless steel cord grip with a silicone grommet. The cord grip 152 is preferably rated for high temperatures, such as, for example, 200° C., so that heat from the lighting element 106 does not damage the cord grip 152.

Referring specifically to FIG. 2, the lighting element housing 104 also includes a vent 120 in the shroud 116 that allows for passage of air from the lighting element housing 104 to the ventilation chamber 108. The vent 120 allows air to enter and exit the lighting element housing 104, which is otherwise sealed by the cover 118, as explained above. The vent 120 includes a filter 114 that prevents contaminants over a certain size from entering the lighting element housing 104. The filter 114 may be any type of filter and may be a metal filter, such as, for example, a stainless steel mesh filter. In some embodiments, the filter 114 is a metal mesh filter that filters particles that are 70 micrometers or larger. The filter 114 is preferably rated for use in high temperatures, such as 200° C., so that the filter 114 is not damaged by air that is heated by the lighting element 106.

As explained above, the lighting element housing 104 contains high-temperature elements, such as, for example, the lighting element 106, that are separated from temperature-sensitive elements, such as those contained in the ballast housing 102, by the ventilation chamber 108. The ventilation chamber 108 includes one or more spacers 110, a perforated screen 112, and a heat dissipation pathway 122. The spacers 110 connect the lighting element housing 104 to the ballast housing 102 and separate the lighting element housing 104 from the ballast housing 102 by a predetermined distance. The spacers 110 may be made of any suitable material and may be any suitable length. In some embodiments, the spacers 110 are between about 2 inches and about 5 inches in length. In some embodiments, the spacers 110 are about 3 inches in length. The distance between the lighting element housing 104 and the ballast housing 102 allows for dissipation of heated air from the lighting element housing 104 by convective heat transfer to air that is moving into and out of the ventilation chamber 108. In addition, the distance between the lighting element housing 104 and the ballast housing 102 substantially prevents heating of the ballast housing 102 by conductive heat transfer from the lighting element housing 104, as might occur if the lighting element housing 104 was connected directly to the ballast housing 102.

The perforated screen 112 encircles and forms the ventilation chamber 108 and allows for airflow into and out of the ventilation chamber 108. Ambient air can flow into and out of the perforated screen 112, allowing for rapid cooling of heated air caused by the lighting element 106. In some cases, for example, the shroud 154 may heat air in the ventilation chamber 108 and heated air that is traveling through the heat dissipation pathway 122 may heat air that contacts a conduit 138 of the heat dissipation pathway 122. The perforated screen 112 allows for the free movement of ambient air adjacent to the shroud 154 and conduit 138 and between the shroud 154 and the ballast housing 126, so that at least a portion of the heat emitted from these elements is dissipated before it reaches the ballast housing 126.

The perforated screen 112 also prevents larger contaminants, such as debris and bugs from entering the ventilation chamber 108. The perforated screen 112 may be made of any suitable materials, such as, for example, perforated aluminum.

The ventilation chamber 108 also includes the heat dissipation pathway 122 that is located in the ventilation chamber 108 adjacent to the vent 120. In operation, the heat dissipation pathway 122 directs heated air that moves through the vent 120 away from the ballast housing 102 and out of the ventilation chamber 108 through the perforated screen 112. In FIG. 2, the heat dissipation pathway 122 includes a conduit 138 that directs the flow of heated air from the vent 120 to the perforated screen 112. The conduit 138 is made of any suitable material, such as metal, and may be connected to an outer surface of the shroud 116 and/or the perforated screen 112.

Figure 3:
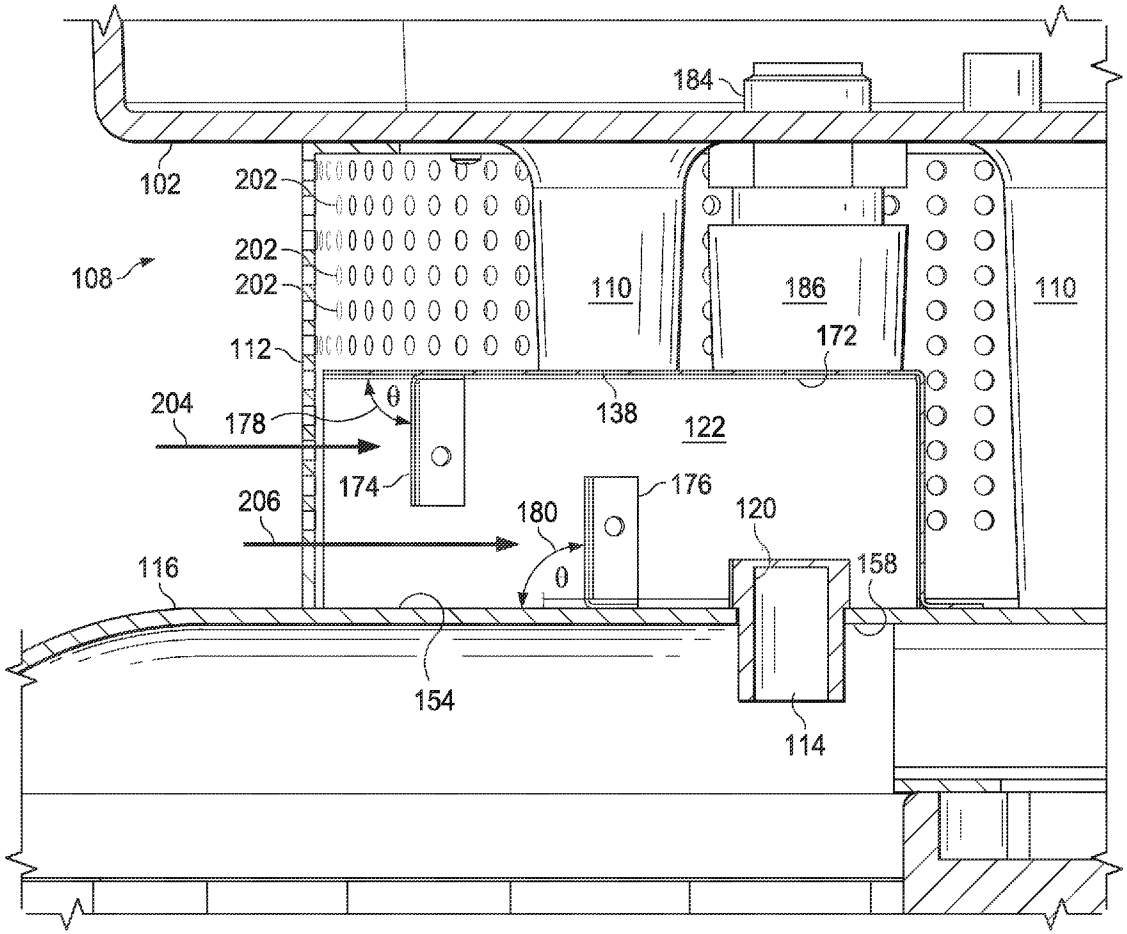
FIG. 3 is a close-up view of a heat dissipation pathway of a lighting apparatus.

Referring now to FIG. 3, the heat dissipation pathway 122 optionally includes baffles 174 and 176 to prevent entry of water and other contaminants that may enter the conduit 138 through the perforated screen 112. A first baffle 174 is coupled to an inner surface 172 of the conduit 138 and a second baffle 176 is coupled to an outer surface 154 of the shroud 116. As shown by the arrow labeled 204, contaminants and/or water that enter the conduit 138 through the perforated screen 112 contacts the first baffle 174, which forces the contaminant and/or water to drop downward. Contaminants and/or water that continue along the second arrow 206 are blocked by the second baffle 176 and thus drop to the outer surface 154 of the shroud 116. Thus, contaminants and/or water that enter the conduit 138 through the perforated screen 112 may be blocked by one or more of the first baffle 174 and the second baffle 176 to prevent the contaminants and/or water from entering the vent 120.

Any number and orientation of baffles 174 and 176 may be used to prevent entry of contaminants into the vent 120. The baffles 174 and 176 are formed be any suitable length, shape and size. Although a first baffle 174 and the second baffle 176 are shown attached at right angles (labeled 178 and 180 in FIG. 3, respectively) to the conduit 138 and the outer surface 154 of the shroud 116, the first baffle 174 and the second baffle 176 may be attached at any angle 178 and 180 to the conduit 138 and the outer surface 154 of the shroud 116. For example, in some embodiments, the first baffle 174 and the second baffle 176 are attached to the conduit 138 and the outer surface 154 of the shroud 116, respectively, such that angles 178 and 180 are less than 90 degrees. In other embodiments, the first baffle 174 and the second baffle 176 are attached to the conduit 138 and the outer surface of the shroud 116, respectively, such that angles 178 and 180 are greater than 90 degrees. In some embodiments, the first baffle 174 is attached to the conduit 138 at a different angle 178 than the angle 180 at which the second baffle 176 is attached to the outer surface 154 of the shroud 116.

Referring back to FIG. 1, the apparatus 100 also includes a ballast housing 102 coupled to the ventilation chamber 108. The ballast housing 102 is formed by and generally includes a cover 128 and a main housing 126. The cover 128 is connectable to the main housing 126, for example, by bolts 182 or other removable attachment mechanisms.

Referring now to FIG. 2, the main housing 126 includes a cord opening 184 that includes a cord grip 186 that accepts the electrical cord (not shown) running from the lighting element 106 to the ballast 130*a* (FIG. 1). The cord grip 186 is configured to create an airtight seal around the cord to allow the cord to pass from the ventilation chamber 108 into the ballast housing 102 without allowing air and other particles to enter the ballast housing 102. The cord grip 186 may be any suitable grip, such as, for example, a stainless steel cord grip with a silicone grommet. In some embodiments, the cord grip 186 is rated for 100° C., so that heat from the lighting element 106 and/or ballast 130*a* does not damage the cord grip 186.

Figure 4:
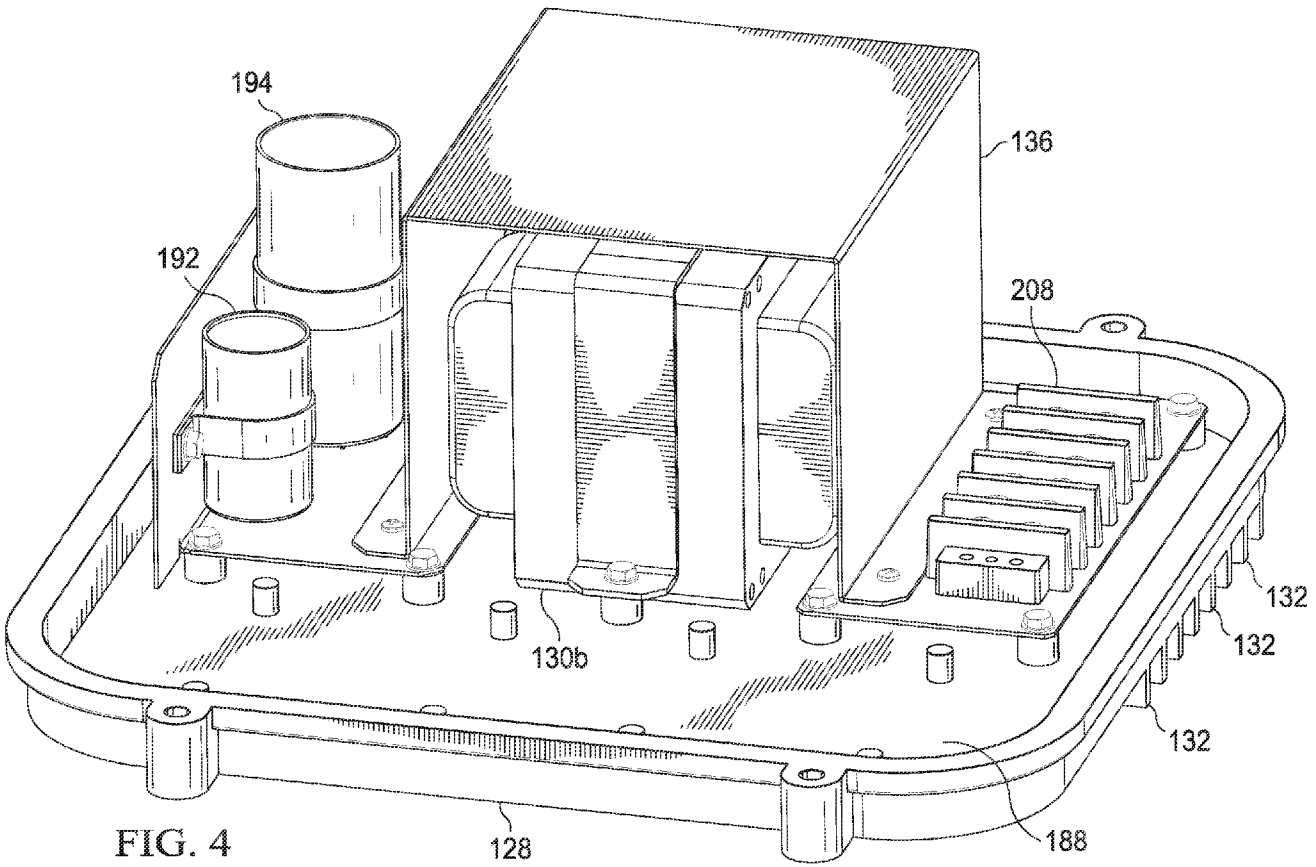
FIG. 4 is a perspective view of a cover of a ballast housing of a lighting apparatus.

Referring again to FIG. 1, the cover 128 is coupleable to the ballast 130*a* and a terminal strip 208, and includes one or more cooling fins 132. The ballast 130*a* may be any suitable ballast, and may be, for example, an electronic ballast. The electronic ballast may have a minimum power factor of 0.98. In other embodiments, the ballast is a magnetic ballast 130*b*, such as a pulse start magnetic ballast, as shown in FIG. 4 and discussed in further detail below. The ballast 130*a* is coupled to the lighting element 106 by a cord and may also connect to a power supply by a cord.

In FIG. 1, the ballast 130*a* is secured to an inner surface 188 of the cover 128 adjacent to the one or more cooling fins 132 located on the outer surface 190 of the cover 108. The cooling fins 132 are operable to dissipate heat generated by the ballast 130*a* to the ambient air.

In some embodiments, the cover 128 also includes a terminal strip 208 for connection of any necessary electrical connections from the ballast 130*a* to any other elements attached to the cover 128. In some embodiments, the lighting element 106 connects to the ballast 130*a* through the terminal strip 208, which is the preferred electrical connection between the elements attached to the cover 128, such as the ballast 130*a*, and the lighting element 106. Thus, the cover 128 can be easily removed from the main housing 126 by disconnecting the terminal strip 208 from the cord.

Referring now to FIG. 4, a magnetic ballast 130*b* may alternatively be connected to the cover 128. The magnetic ballast 130*b* typically requires an igniter 192 and a capacitor 194 that are secured to the cover 128. A heat shield 136 preferably encloses the magnetic ballast 130*b* to reduce the amount of radiant heat from the magnetic ballast 130*b* that reaches the igniter 192 and the capacitor 194, which are heat-sensitive elements. The magnetic ballast 130*b* and heat shield 136 are connected to an inner surface 188 of the cover 128 adjacent to the cooling fins 132 so that the cooling fins 132 dissipate at least a portion of the heat produced by the magnetic ballast 130*b* to ambient air.

In operation, the lighting element 106 is energized and begins to produce light and thus, heat. Depending on the particular lighting element 106, the lighting element 106 operates at a temperature of about 200° C., and heats the air inside the lighting element housing 104. Since in some embodiments the lighting element housing 104 is sealed by the cover 118, the heated air inside the lighting element housing 104 escapes the lighting element housing 104 through the vent 120. Heated air is directed through the vent 120 by the conduit 138 to travel along the heat dissipation pathway 122 toward the perforated screen 112. The heated air then passes through the perforated screen 112 to the ambient air.

The shroud 116 and the conduit 138 are also heated during operation by the heated air in the lighting element housing 104. Heat from the shroud 116 and the conduit 138 may heat air within the ventilation chamber 108. The air within the ventilation chamber 108 is carried away from the ventilation chamber 108 through the openings 202 (see FIG. 3) in the perforated screen 112 and ambient air is free to enter and exit the ventilation chamber 108 through the openings 202 in the perforated screen 112. Thus, the ventilation chamber 108 and perforated screen 112 allow heated air to dissipate and/or otherwise be carried away from the ventilation chamber 108 to minimize heating of the ballast chamber 102.

In addition, during operation the ballast 130*a* or 130*b* produces heat. In some embodiments, the heat produced by the ballast 130*a* or 130*b* is blocked by the heat shield 136, as shown in FIG. 4, before encountering heat-sensitive elements within the ballast housing 102, such as the igniter 192 and capacitor 194. The cooling fins 132 are sized and otherwise used to dissipate heat produced by the ballast 130*a* or 130*b* to the ambient air while the ballast 130*a* or 130*b* is operating.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, any use of the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention(s) are not to be limited to the disclosed embodiments, but on the contrary, are intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A high mast lighting apparatus, comprising:

a ballast housing;

a lighting element housing comprising a lighting element, wherein the lighting element housing is substantially sealed except for a vent;

a ventilation chamber disposed between the ballast housing and the lighting element housing, wherein the ventilation chamber comprises:

one or more spacers coupling the ballast housing to the lighting element housing;

a heat dissipation pathway for providing a heat passageway from the lighting element away from the ballast housing, wherein the heat dissipation pathway comprises a conduit with one or more baffles for preventing contaminants from reaching the vent; and a perforated screen enclosing the ventilation chamber, the vent, and the one or more spacers.

2. The high mast lighting apparatus of claim 1, wherein the one or more spacers maintain a distance between the ballast housing and the lighting element housing of between about two inches and about five inches.

3. The high mast lighting apparatus of claim 1, wherein the perforated screen is metal and is disposed between the ballast housing and the lighting element housing.

4. The high mast lighting apparatus of claim 1, wherein the lighting element housing comprises a filter to filter air that enters and exits the lighting element housing.

5. The high mast lighting apparatus of claim 1, wherein the lighting element housing comprises a shroud, and a cover for substantially sealing the lighting element housing, wherein air flow into and out of the lighting element housing is restricted to the vent.

6. The high mast lighting apparatus of claim 1, wherein the ballast housing comprises a main housing, a cover connectable to the main housing, and a ballast, wherein the ballast is connected to the cover and the cover comprises at least one cooling fin disposed on an opposite side of the cover from the ballast to dissipate heat generated from the ballast.

7. The high mast lighting apparatus of claim 1, wherein the ballast housing comprises a ballast and a heat shield, wherein the ballast is located inside the heat shield.

8. The high mast lighting apparatus of claim 1, wherein the vent further comprises a filter.

9. A lighting apparatus, comprising:

a ballast housing;

a lighting element housing including a vent;

a ballast in the ballast housing electrically connected to a lighting element in the lighting element housing; and a ventilation chamber located between the ballast housing and the lighting element housing, wherein the ventilation chamber comprises a heat dissipation pathway for diverting heat from the lighting element away from the ballast, wherein the heat dissipation pathway comprises a conduit coupled to an outer surface of the lighting element housing at the vent, wherein the conduit is spaced from the ballast housing by a distance and directs heated air from the lighting element housing away from the ballast housing.

10. The lighting apparatus of claim 9, wherein the lighting element is a high intensity discharge light.

11. The lighting apparatus of claim 9, wherein the ballast is a pulse start ballast.

12. The lighting apparatus of claim 9, wherein the ballast is an electronic ballast.

13. The lighting apparatus of claim 9, wherein the ballast is a pulse start magnetic ballast.

14. The lighting apparatus of claim 9, wherein the conduit is metal and includes at least one baffle located within the conduit.

15. The lighting apparatus of claim 9, wherein the ballast is a magnetic ballast and the lighting apparatus includes an igniter and capacitor coupled to the magnetic ballast.

16. The lighting apparatus of claim 15, further comprising a heat shield between the magnetic ballast and the igniter and capacitor.

17. A lighting apparatus, comprising:

a lighting element housing, wherein the lighting element housing is substantially sealed except for a vent that comprises a filter;

a ballast housing comprising a ballast;

a ventilation chamber disposed between the ballast housing and the lighting element housing, wherein the ventilation chamber comprises:

a rigid spacer connecting the ballast housing to the lighting element housing and maintaining a distance between the ballast housing and the lighting element housing; and a heat dissipation pathway for providing a heat passageway from the lighting element housing away from the ballast housing, wherein the heat dissipation pathway comprises a conduit with one or more baffles for preventing contaminants from reaching the vent; and a perforated screen enclosing the rigid spacer between the lighting element housing and the ballast housing.

18. The lighting apparatus of claim 17, wherein the lighting element housing comprises a cord grip that provides an air tight seal around a portion of a cord connecting the lighting element housing to the ballast.

* * * * *